US008312697B2

(12) United States Patent
Anderson

(10) Patent No.: US 8,312,697 B2
(45) Date of Patent: Nov. 20, 2012

(54) CONVERTIBLE PACKAGING

(75) Inventor: Neal Anderson, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 246 days.

(21) Appl. No.: 12/783,001

(22) Filed: May 19, 2010

(65) Prior Publication Data

US 2010/0223890 A1 Sep. 9, 2010

Related U.S. Application Data

(62) Division of application No. 12/098,325, filed on Apr. 4, 2008, now Pat. No. 7,748,528.

(51) Int. Cl.
*B65B 3/04* (2006.01)

(52) U.S. Cl. ..... 53/474; 53/266.1; 53/284.5; 206/326; 206/576

(58) Field of Classification Search ..... 53/474, 53/266.1, 284.5; 206/326, 576
See application file for complete search history.

(56) References Cited

U.S. PATENT DOCUMENTS

| | | | |
|---|---|---|---|
| 728,386 | A | 5/1903 | Finne, Jr. |
| 1,908,965 | A | 5/1933 | Dowst |
| 1,982,780 | A | 12/1934 | Behrens |
| 2,084,308 | A | 6/1937 | Behr |
| 2,232,953 | A | 2/1941 | Mallgraf |
| 2,351,931 | A | 6/1944 | Debs |
| 2,714,448 | A | 8/1955 | Brown |
| 2,723,488 | A | 11/1955 | Ringler |
| 2,810,474 | A | 10/1957 | Essick |
| 2,811,281 | A | 10/1957 | Donovan |
| 3,044,211 | A | 7/1962 | Palm |
| 3,119,494 | A | 1/1964 | Rosenstiel |
| 3,195,265 | A | 7/1965 | Marquez et al. |
| 3,992,849 | A | 11/1976 | Lett, III |
| 4,380,289 | A | 4/1983 | Bigelow |
| 4,556,253 | A | 12/1985 | Geneve et al. |
| 4,646,959 | A | 3/1987 | Sheffer |
| 4,648,548 | A | 3/1987 | Shin |
| 4,694,954 | A | 9/1987 | Moss |
| 4,780,975 | A | 11/1988 | Friedman |
| 4,919,263 | A | 4/1990 | Baltzer et al. |
| 4,947,797 | A | 8/1990 | Lawrence, Jr. |
| 4,957,201 | A | 9/1990 | Wieting |
| 5,255,841 | A | 10/1993 | Ritter |
| 5,263,766 | A | 11/1993 | McCullough |
| 5,381,890 | A | 1/1995 | Scobbie |

(Continued)

OTHER PUBLICATIONS

U.S. Appl. No. 12/098,325, filed Apr. 4, 2008 and issued on Jul. 6, 2010 as U.S. Patent No. 7,748,528.

*Primary Examiner* — Thanh Truong
(74) *Attorney, Agent, or Firm* — Merek, Blackmon & Voorhees, LLC

(57) ABSTRACT

A shipping system comprises an article of furniture and a packaging assembly. The packaging assembly includes a container and a protective insert. The container houses the article of furniture. The protective insert is disposed within the container and is positioned to help protect the article of furniture from damage. The protective insert has at least one convertible portion that is adapted to be removed from a surrounding portion of the protective insert, transition between a first configuration and a second configuration, and form at least a portion of an accessory product for the article of furniture when the convertible portion is in the second configuration.

20 Claims, 7 Drawing Sheets

U.S. PATENT DOCUMENTS

| | | | | |
|---|---|---|---|---|
| 5,458,521 | A | 10/1995 | Todd | |
| 5,601,230 | A | 2/1997 | Bell | |
| 5,673,796 | A | 10/1997 | Tulloch | |
| 5,730,085 | A * | 3/1998 | Santoiemmo | 119/168 |
| 5,904,410 | A | 5/1999 | Davies | |
| 6,012,842 | A | 1/2000 | Openiano | |
| 6,059,179 | A | 5/2000 | Giampapa | |
| 6,189,775 | B1 | 2/2001 | Wu | |
| 6,260,707 | B1 | 7/2001 | Harris | |
| 6,578,757 | B1 * | 6/2003 | Espenshied et al. | 229/92.8 |
| 6,631,803 | B2 * | 10/2003 | Rhodes et al. | 206/427 |
| 6,905,338 | B1 | 6/2005 | Garran | |
| 6,973,686 | B2 | 12/2005 | Kenan | |
| 7,748,528 | B2 | 7/2010 | Anderson | |
| 2004/0149603 | A1 | 8/2004 | Hodsdon | |
| 2005/0072340 | A1 * | 4/2005 | Shabram et al. | 108/35 |
| 2007/0144930 | A1 | 6/2007 | Robson | |
| 2008/0000118 | A1 | 1/2008 | Suzuki | |

* cited by examiner

CONVERTIBLE PACKAGING

This application is a divisional of U.S. patent application Ser. No. 12/098,325, filed Apr. 4, 2008, pending, the entire content of which is hereby incorporated by reference in this application.

BACKGROUND

Products are typically shipped in packaging assemblies such as boxes or other types of containers. The containers help facilitate shipment of the products, for example by protecting the products from damage. Products are shipped in containers in an assembled manner, or the products are shipped in an unassembled manner and the product is assembled after removal from the packaging assembly. In addition, some packaging assemblies include protective inserts. Protective inserts are placed between or around portions of the product. Such protective inserts protect the product from damage during shipment by helping to prevent portions of the product from damaging one another. Other protective inserts are configured to reinforce the container in addition to protecting the product.

SUMMARY

Some aspects of the present invention relate to a shipping system including an article of furniture and a packaging assembly. The packaging assembly includes a container and a protective insert. The container houses the article of furniture. The protective insert is disposed within the container and is positioned to help protect the article of furniture from damage. The protective insert has at least one convertible portion that is adapted to be removed from a surrounding portion of the protective insert, adapted to transition between a first configuration and a second configuration, and adapted to form at least a portion of an accessory product for the article of furniture when the convertible portion is in the second configuration.

While some aspects of the invention have been described above, still other aspects of the present invention will become apparent to those skilled in the art from the following detailed description. Accordingly, the summary is intended to be generally indicative of some aspects of the invention, but not restrictive in nature.

Figure 1:
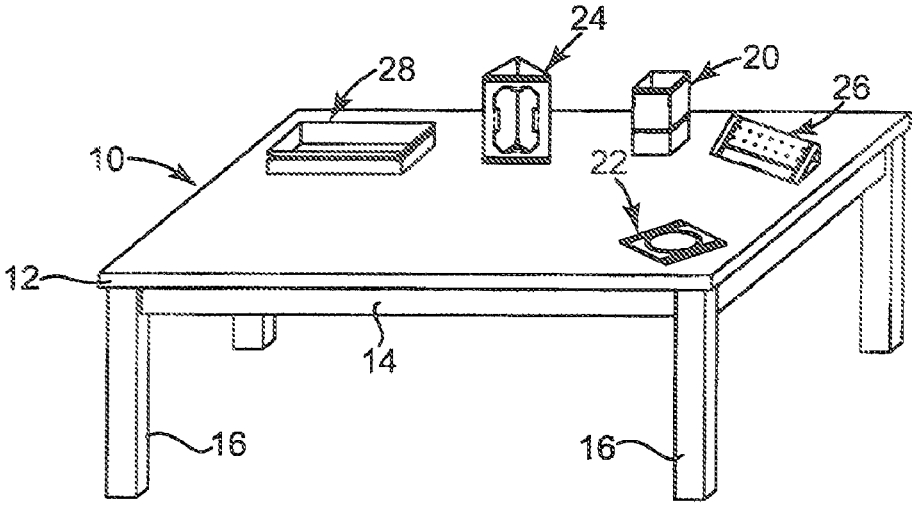
FIG. 1 is a primary product with accessory products, according to some embodiments.

While the invention is amenable to various modifications and alternative forms, some embodiments have been shown by way of example in the drawings and are described in detail below. As referenced above, the intention, however, is not to limit the invention by those examples. On the contrary, the invention is intended to cover all modifications, equivalents, and alternatives.

DETAILED DESCRIPTION

In general terms, some aspects of the invention relate to packaging systems where pieces of a primary product, such as an unassembled desk, are packaged in a shipping container, such as a cardboard box. The pieces of the product are shipped with protective inserts (e.g., sheets of packing cardboard) between them. The protective insert(s) are adapted to be formed into accessory products, such as desk accessories. In some embodiments, the protective insert(s) are scored so that a consumer, or other user, is able to punch out accessory blanks and fold or otherwise form them into the accessory products intended for use with the primary product (e.g., a pencil holder to be used with a desk).

As will be described in greater detail, the primary product, also described as a retail item or main product, is provided with one or more secondary products via packaging materials used to ship or otherwise house the primary product. As alluded to above, the primary product is optionally an article of furniture, also described as a furniture assembly or a furniture member. During storage and/or shipment, the primary product is at least partially protected by a packaging assembly, which can also be described as a shipping assembly, a shipping module, or a protective packaging. The primary product is optionally disposed within the packaging in an assembled or unassembled state as desired.

In some embodiments, the packaging assembly includes an outer container (e.g., a box), which can also be described as outer packaging or a shipping container and one or more protective inserts, which are also described as shipping inserts, packaging inserts, shipping members, or packing/packaging members. The protective inserts are optionally used together with the container to protect the primary product during storage and/or shipment.

The packaging assembly has one or more convertible portions, or accessory portions, that are convertible from a first, shipping configuration to a second, accessory configuration. In the first configuration, the convertible portions are configured as a portion of the packaging assembly. In the second configuration, the convertible portions are configured as secondary products, or accessories. The secondary products are for use with the primary product and as such are accessory products for the primary product. The secondary products can also be described as accessory members, accessory products, accessories, appurtenances, or supplementary products. In some embodiments, packaging assemblies that include convertible portions are environmentally friendly or otherwise help reduce waste by making use of portions of the packaging assembly that might otherwise be discarded or inefficiently used.

For example, in FIG. 1, a primary product 10 is shown with a plurality of accessory products 20, 22, 24, 26, 28. In some embodiments, the primary product 10 is a desk 10 having a desk top 12, a desk rail 14 providing support to the desk top 12, and desk legs 16. The accessory products 20, 22, 24, 26, 28 are optionally a pencil holder 20, a coaster 22, a picture frame 24, a desk organizer 26 and an inbox/outbox 28, respectively, where each of the accessory products is optionally formed from a portion of protective packaging used to house the primary product 10 for shipping, for example.

Figure 2:
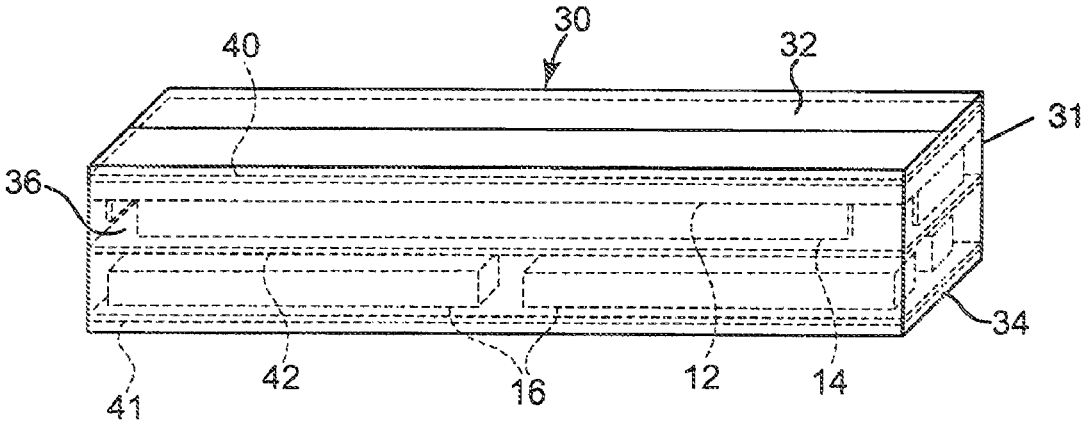
FIG. 2 shows the primary product of FIG. 1 packaged in a box.

FIG. 2 shows the desk 10 of FIG. 1 disposed in a packaging assembly 30 including an outer packaging 31, such as a box or other container. The outer packaging 31 includes a top 32, a bottom (not shown), ends 34, and sides 36. The packaging assembly 30 also optionally includes one or more protective inserts 40, 41, 42. The protective inserts 40, 41, 42 interact with other portions of the packaging assembly 30 such as the outer packaging 31 to strengthen the outer packaging 31 and/or to protect the primary product 10 during storage and/or shipment, for example by separating and cushioning portions of the primary product 10 from each other.

In some embodiments, the top 32 has two flaps that have an open and a closed configuration (the flaps are shown in FIG. 2 in the closed configuration). An optional outer protective insert 40 is placed between the top 32 and the primary product 10. An outer protective insert 41 is also optionally disposed between the primary product 10 and the bottom of the outer packaging 31. The outer protective inserts 40, 41 reinforce the top 32 and bottom, respectively. Together with the outer packaging 31, the outer protective inserts 40, 41 also protect the primary product 10 during shipment. Other outer protective inserts (not shown) are optionally included between the primary product 10 and one or both of the ends 34 and/or between the primary product 10 and one or more of the sides 36.

As alluded to above, the desk 10 is optionally disposed in the outer packaging 31 in an unassembled state, or configuration, as shown in FIG. 2. The legs 16 are optionally removed from the desk top 12 with the legs 16 disposed between the lower outer protective insert 41 and an inner protective insert 42. The desk top 12 is optionally disposed between the inner protective insert 42 and the upper outer protective insert 40. The inner protective insert 42 separates the desk top 12 from the desk legs 16, helping to prevent these different portions of the desk 10 from damaging one another during storage and/or shipment.

In some embodiments, the protective inserts 40, 41, 42 are in the form of a sheet of packaging material such as cardboard, although a variety of packaging materials are contemplated. Though not specifically shown, additional or alternative protective inserts are also optionally folded or arranged into configurations to surround portions of the primary product 10 to provide additional protection during storage and/or shipment. In addition, in some embodiments, protective inserts are folded or arranged to form sub-containers and/or divisions within the outer packaging 31. These sub-containers or divisions are configured for packaging a portion of the primary product 10 and/or other items that are shipped with the primary product 10 (e.g., additional accessory products, directions for assembly, hardware for assembling the primary or accessory products, or others). Although the embodiments described below and shown in the figures include protective inserts in the form of a flat sheet of packing material with convertible portions, any portions of the packaging assembly 30 optionally comprise one or more convertible portions such as those described below. For example, in some embodiments the outer packaging 31 comprises any of the convertible portions described herein.

In some embodiments, the outer packaging 31 and the protective inserts 40, 41, 42 are made of packaging materials such as cardboard or paperboard. The cardboard is optionally corrugated cardboard, and in some embodiments the weights of the cardboard is from about 150 gsm to about 300 gsm, although other weights are contemplated. In addition, in some embodiments the outer packaging 31 comprises one weight of cardboard or paperboard (e.g., 300 gsm) while the protective inserts 40, 41, 42 comprise a different weight of cardboard or paperboard (e.g., 150 gsm).

Figure 3:
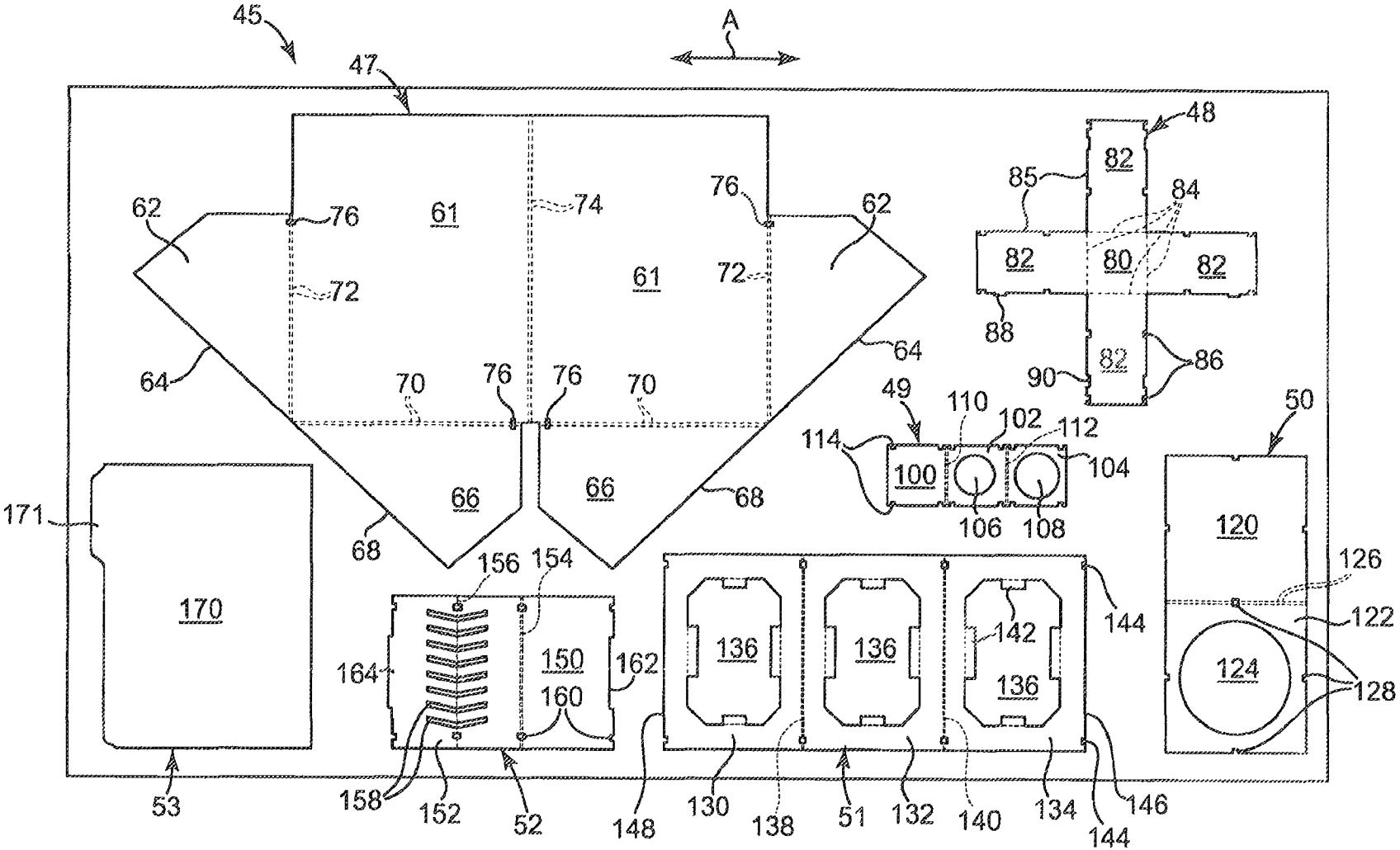
FIG. 3 shows a protective insert with convertible portions, according to some embodiments.
Figure 4:
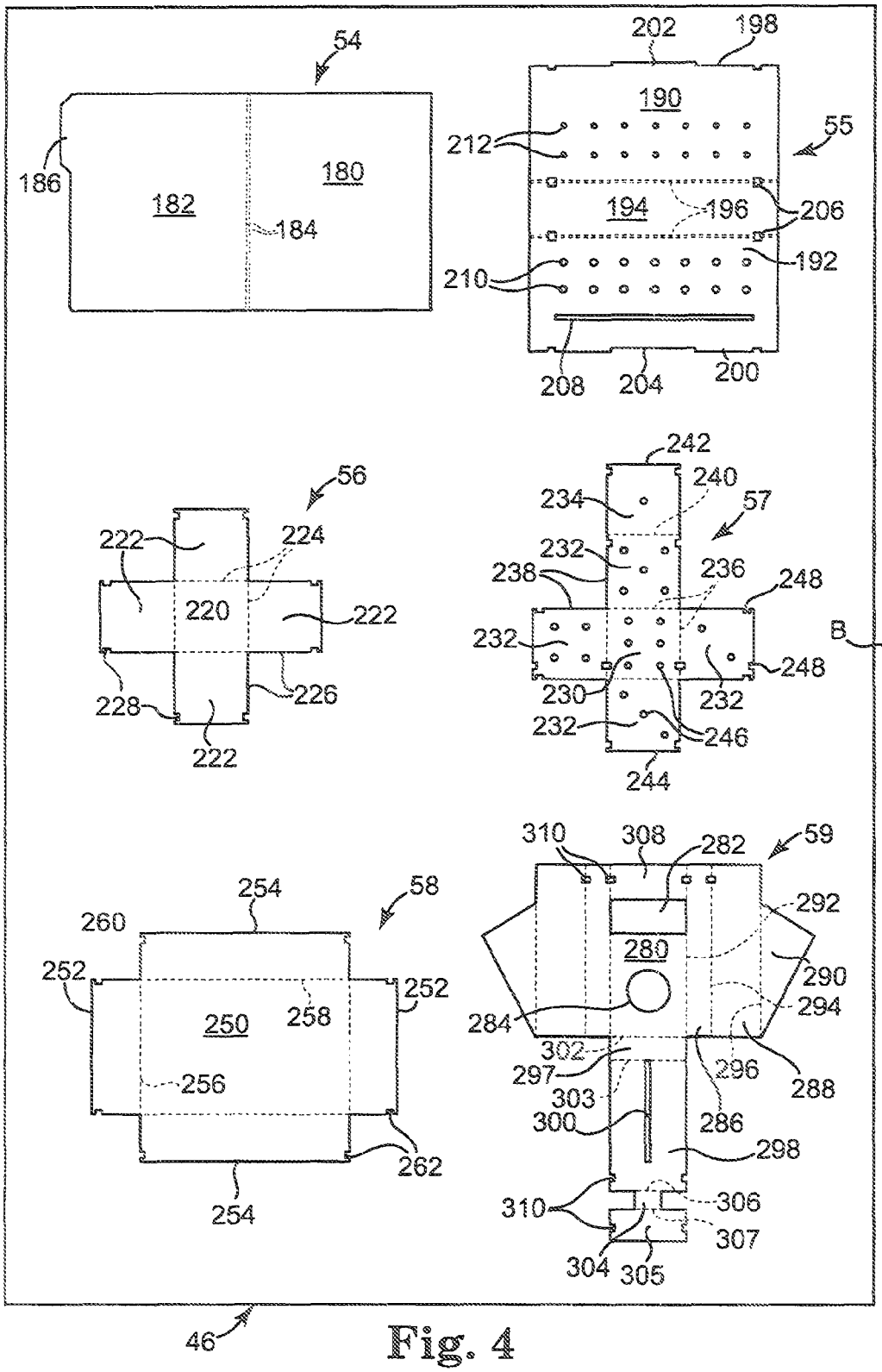
FIG. 4 shows another protective insert with convertible portions, according to some embodiments.

In some embodiments, the convertible portion or portions of the packaging assembly 30 are formed by perforating or scoring blanks in the shape of the convertible portion(s) in a portion of the packaging assembly 30. The perforation or scoring provides a weakened portion of the packaging assembly 30 that is then punched out from the surrounding non-convertible portion of the packaging assembly 30. In this way, the convertible portion(s) are removed from the surrounding non-convertible portions and is converted into one or more accessory products. The perforation or scoring in the packaging assembly 30 is shown in FIGS. 3 and 4 with solid lines and generally correspond to structures of various accessory products.

Also, as explained in detail below with respect to FIGS. 3-17, fold lines are provided in the convertible portions of some embodiments. These fold lines are provided by making an impression or indentation along the fold lines of the convertible portions. The fold lines in the convertible portions are shown in FIGS. 3 and 4 with broken lines and generally correspond to structures of various accessory products.

In some embodiments, all or a portion of a convertible portion is printed. For example, one or more of the convertible portions are printed to improve the aesthetics of accessory products that are formed from the one or more convertible portions of a packaging assembly 30. In other embodiments, one or more convertible portions are coated, for example with a protective coating, a waterproof coating, a water resistant coating, or with other types of coatings.

The packaged primary product shown in FIG. 2 also optionally includes other items, such as directions for using and/or assembling the primary product 10 and accessory products, along with any tools or hardware that are required for assembly or use of the primary product 10 or accessory products.

Shown in FIGS. 3 and 4 are example embodiments of protective inserts. As mentioned above, the protective inserts 45, 46 are placed in a container in order to protect the primary product 10 and/or reinforce the container. For example, either or both of the protective inserts 45, 46 are optionally disposed within the outer packaging 31 as any of protective inserts 40, 41, 42 shown in FIG. 2.

The protective inserts 45, 46 have convertible portions. For example, protective insert 45 in FIG. 3 has convertible portions 47-53 and protective insert 46 in FIG. 4 has convertible portions 54-59. The convertible portions have a first configuration and a second configuration. In the first configuration, the convertible portions are in a packaging configuration as shown in FIGS. 3 and 4, and are configured to protect the primary product 10 and/or reinforce the packaging assembly 30. In the second configuration, the convertible portions are configured as accessory products for the primary product 10.

In embodiments where the protective inserts 40, 41, 42 comprise corrugate materials, the corrugate material is optionally oriented in a predetermined direction. For example, the corrugate direction is oriented as shown by arrow A in FIG. 3 and arrow B in FIG. 4, although other corrugate orientations are possible.

Figure 5:
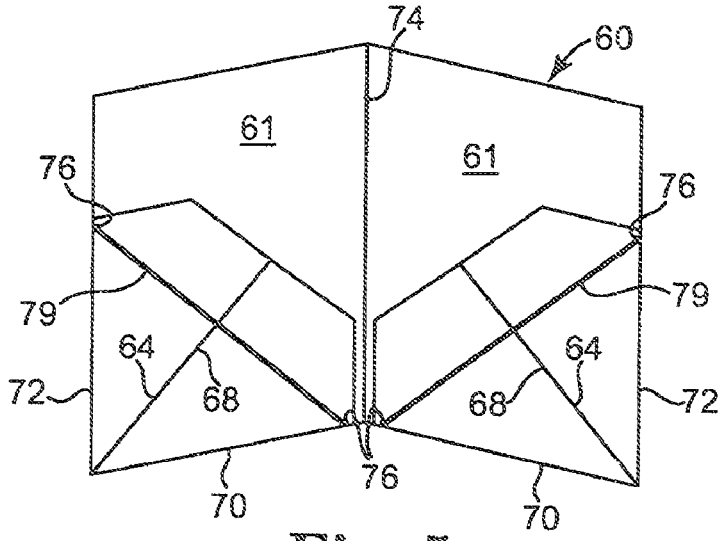
FIG. 5 shows a convertible portion of a packaging assembly converted into the form of a portfolio, according to some embodiments.

Turning to FIG. 3, protective insert 45 has convertible portions 47-53. These convertible portions 47-53 are each shown in a first configuration. Convertible portion 47 has a first configuration as shown in FIG. 3 and a second configuration as shown in FIG. 5. In the second configuration, the convertible portion 47 forms a portfolio 60 having pockets that are configured to hold papers. The portfolio 60 has two sides 61 that are demarcated by two fold lines 74. The sides 61 are folded toward and away from one another along the fold lines 74 in order to change the portfolio 60 between an open and a closed configuration. The portfolio 60 is shown in FIG. 5 in an open configuration.

In some embodiments, two adjacent fold lines help facilitate folds of greater than 90 degrees. For example, adjacent fold lines 74 help facilitate the 180 degree fold that is formed between the two sides 61 when the portfolio is in a closed configuration. It should be noted that, although two adjacent fold lines are shown only for folds of greater than 90 degrees, two or more adjacent fold lines are optionally used to help facilitate any of the folds described herein. In addition, in embodiments where two or more adjacent fold lines are shown, a single fold line is optionally used, for example when the packaging material being used has a relatively high level of flexibility.

In addition, each side 61 of the portfolio 60 has upper flaps 62 that each have an inner edge 64 and lower flaps 66 that each have an inner edge 68. The upper flaps 62 are demarcated from the sides 61 along adjacent fold lines 72, which help allow the upper flaps 62 to be folded in toward the center of the portfolio 60 as shown in FIG. 5. The lower flaps 66 are demarcated from the sides 61 along adjacent fold lines 70, which help allow the lower flaps 66 to be folded upward toward the top of the portfolio 60 as shown in FIG. 5. When the upper flaps 62 are folded inward and the lower flaps 66 are folded upward as shown in FIG. 5, the edges 64, 68 are disposed adjacent to, or in some cases touching, one another, forming pockets. The portfolio 60 also includes notches 76. These notches 76 are formed along the outside and bottom of the sides 61. When the flaps 62, 66 are in a folded configuration, an elastic band 79 is placed across the flaps 62, 66 and through the notches 76 in order to hold the flaps 62, 66 in the configuration shown in FIG. 5. The notches 76 keep the elastic bands 79 in place around the flaps 62, 66 of the portfolio 60. The elastic bands 79 in this embodiment, and in other embodiments described herein, are optionally rubber bands or packing bands or another type of fastener. For example, in some embodiments clips or tape are used in addition to or in place of the elastic bands 79 to help maintain the portfolio 60 in the configuration shown in FIG. 5. In addition, fastening means such as adhesive are also contemplated for fastening adjacent portions of an accessory product to one another.

Figure 6:
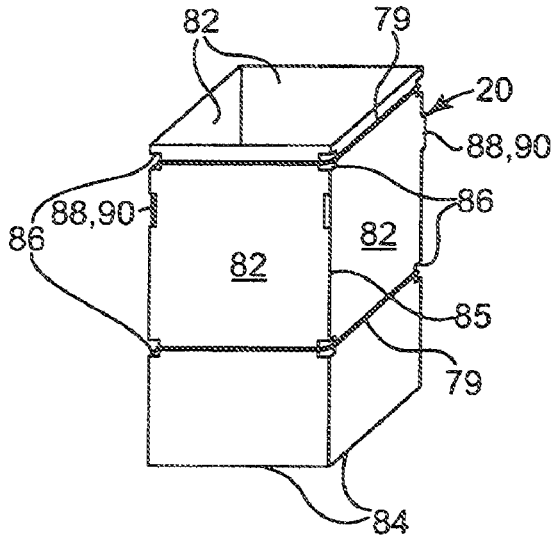
FIG. 6 shows a convertible portion of a packaging assembly converted into the form of a pencil holder, according to some embodiments.

Convertible portion 48 has a first configuration as shown in FIG. 3 and a second configuration as shown in FIG. 6. In the second configuration, the convertible portion 48 forms a pencil holder 20. The pencil holder 20 has a large opening that accommodates two or more writing utensils. The pencil holder 20 has a base 80 (shown in FIG. 3) and four sides 82. The sides 82 are demarcated from the base 80 by fold lines 84, and the sides 82 each have two edges 85. Formed on the edges 85 are notches 86. The sides 82 are folded upward relative to the base 80 along the fold lines 84 in order to form sides of the pencil holder 20, as shown in FIG. 6. In some embodiments, elastic bands 79 are disposed through the notches 86 and around the sides 82 of the pencil holder 20 in order to help maintain the pencil holder 20 in the second configuration. Further, each pair of adjacent edges 85 has a tab 88 on one of the adjacent edges 85 and a corresponding alignment notch 90 on the other adjacent edge 85. When the sides 82 are folded upward, forming the pencil holder 20, the tabs 88 fit into the corresponding alignment notch 90 to help ensure that the adjacent edges 85 are aligned properly.

Figure 7:
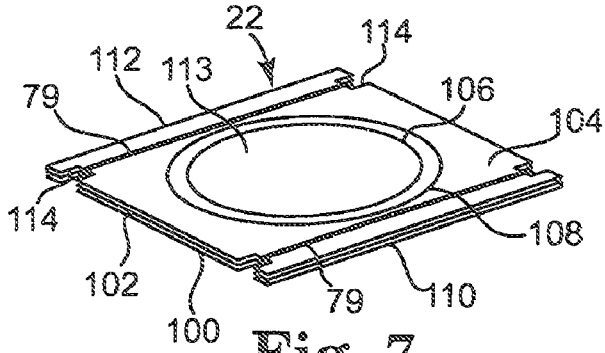
FIG. 7 shows a convertible portion of a packaging assembly converted into the form of a coaster, according to some embodiments.

Convertible portion 49 has a first configuration as shown in FIG. 3 and a second configuration as shown in FIG. 7. In the second configuration, the convertible portion 49 forms a coaster 22. The convertible portion 49 has three panels 100, 102, 104 (as best shown in FIG. 3). Panel 102 has a first cut-out 106 and panel 104 has a second, larger, cut-out 108. As shown, the cut-outs 106, 108 are round; however, the cut-outs 106, 108 are any desired shape such as a square or rectangle. Panels 100 and 102 are demarcated from one another by adjacent fold lines 110. The fold lines 110 help allow the panels 100, 102 to be folded over on to one another, as shown in FIG. 7. In addition, panels 102, 104 are demarcated from one another by adjacent fold lines 112. The fold lines 112 help allow the panels 102, 104 to be folded over onto one another, as shown in FIG. 7. Panel 100 forms the base of the coaster 22, panel 102 forms an intermediate layer of the coaster 22, and panel 104 forms a top layer of the coaster 22. The cut-out 106 for panel 102 is smaller than the cut-out 108 for panel 104, and as such the coaster 22 has a tiered opening 113. The coaster 22 also has notches 114 which, as shown in FIG. 7, are aligned with one another when the panels 100, 102, 104 are in the second configuration. Elastic bands 79 are placed around the coaster 22 through the notches 114 in order to help maintain the coaster 22 in the second configuration.

Figure 8:
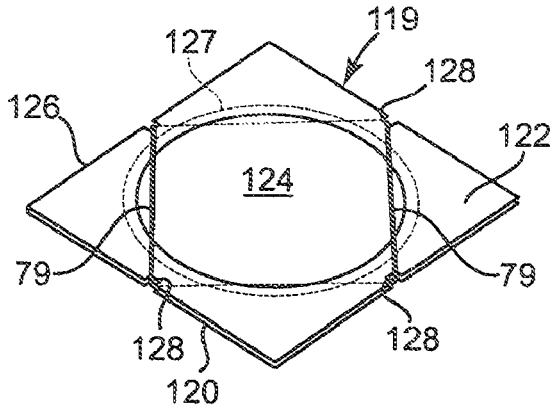
FIG. 8 shows a convertible portion of a packaging assembly converted into the form of a holder for a storage media, according to some embodiments.

Convertible portion 50 has a first configuration as shown in FIG. 3 and a second configuration as shown in FIG. 8. In the second configuration, the convertible portion 50 forms a case 119 for holding storage media such as a CD or DVD 127. The convertible portion 50 has two panels 120, 122, where panel 122 has a cut-out 124. The cut-out 124 is sized to be slightly smaller than the storage media being held, for example a standard CD or DVD. The cut-out 124 is shown as a round cut-out. In other embodiments, the cut-out is other shapes such as a square or rectangle. The panels 120, 122 are demarcated by adjacent fold lines 126. Panel 120 and panel 122 are folded over on one another to form the case as shown in FIG. 8. In FIG. 8, a CD 127 (shown in phantom) is placed between the panels 120, 122. Because the cut-out 124 is smaller in size than the CD, a portion of the CD is viewed through the cut-out while securing the CD in the case 119. Further, the case 119 has notches 128 and an elastic band 79 is optionally disposed around the case 119 through the notches 128, helping to maintain the case 119 in the second configuration and helping to maintain the CD within the case 119.

Figure 9:
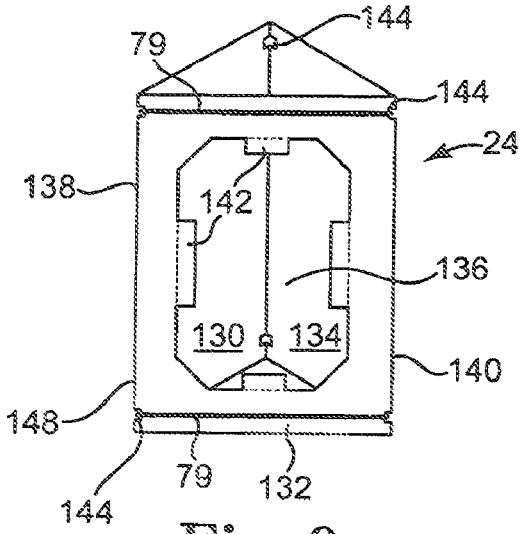
FIG. 9 shows a convertible portion of a packaging assembly converted into the form of a picture frame, according to some embodiments.

Convertible portion 51 has a first configuration as shown in FIG. 3 and a second configuration as shown in FIG. 9. In the second configuration, the convertible portion 51 forms a picture frame 24. The picture frame 24 has three panels 130, 132, 134, and each of the panels 130, 132, 134 has a display opening 136 formed therein. The panels 130, 132 are demarcated from one another by adjacent fold lines 138, and panels 132, 134 are demarcated from one another by adjacent fold lines 140. As shown in FIG. 3, the convertible portion 51 has ends 146, 148. Fold lines 138 and 140 are folded (e.g., about a 120 degree fold) to bring the ends 146, 148 into contact, as shown in FIG. 9. The picture frame 24 also has notches 144. The notches 144 are aligned with one another above and below the display openings 136. Elastic bands 79 are placed around the picture frame 24, helping to maintain the picture frame 24 in the second configuration. The picture frame 24 also has tabs 142 for holding a picture or other display item inside the display openings 136.

Figure 10:
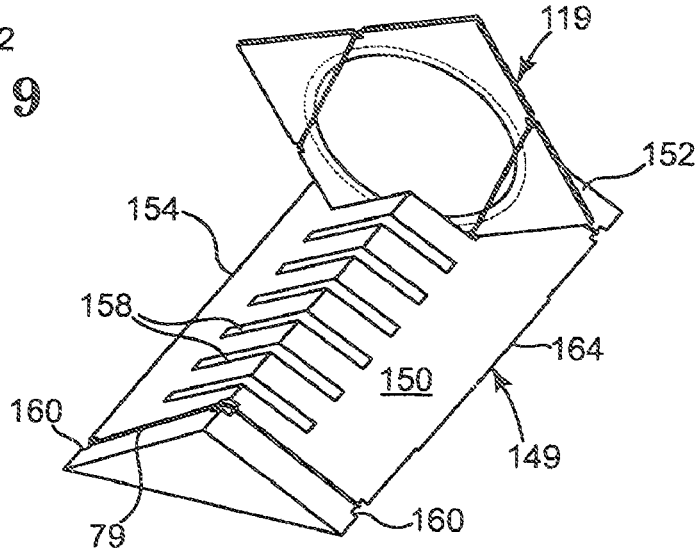
FIG. 10 shows a convertible portion of a packaging assembly converted into the form of a rack, according to some embodiments.

Convertible portion 52 has a first configuration as shown in FIG. 3 and a second configuration as shown in FIG. 10. In the second configuration, the convertible portion 52 forms a rack 149, for example a CD rack. The convertible portion 52 has a base panel 150 and an upper panel 152. Adjacent fold lines 154 demarcate the base panel 150 from the upper panel 152. The upper panel 152 is demarcated into two sub-panels by a fold line 156 (as shown in FIG. 3), which helps allow the upper panel 152 to be folded into a raised configuration, as shown in FIG. 10. The upper panel 152 also has one or more slots 158 to receive a case for storage media, for example the case 119 described above. An elastic band 79 is also optionally placed around the rack 149 and through the notches 160 in order to help maintain the rack 149 in the second configuration. Also, in the second configuration the notch 162 and the tab 164 fit together in order to help ensure alignment of the upper and lower panels 150, 152 of the rack 149.

Convertible portion 53 has a first configuration as shown in FIG. 3 and a second configuration where the convertible portion 53 forms a file divider. The convertible portion 53 has a panel 170 and a tab 171 formed on one side of the panel 170. The convertible portion 53 is able to be removed from the protective insert 45 to form the file divider (the file divider is not shown separately). The tab 171 is a raised portion of the file divider on which an identifier is optionally placed for identifying groups of files.

Turning to FIG. 4, protective insert 46 has convertible portions 54-59. These convertible portions 54-59 are each shown in a first configuration. As mentioned above, in the first configuration these convertible portions 54-59 are configured to protect the primary product 10 and/or reinforce a portion of a container or box. In the second configuration these convertible portions 54-59 form accessory products 22, 24, 26, 28, 60, 119, 149, 219, 229.

Convertible portion 54 has a first configuration as shown in FIG. 4 and a second configuration (not shown in a separate figure) that forms a file folder. The convertible portion 55 has a first panel 180 and a second panel 182. The panels 180, 182 are demarcated from one another along adjacent fold lines 184. The panels 180, 182 are folded toward one another along the adjacent fold lines 184, forming a file folder. The convertible portion 55 also has a tab 186, which forms a raised portion that is used for identification of the contents of the file folder.

Figure 11:
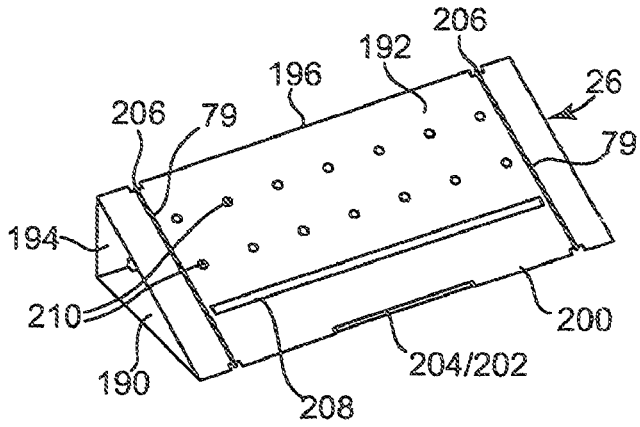
FIG. 11 shows a convertible portion of a packaging assembly converted into the form of an alternative pencil holder, according to some embodiments.

Convertible portion 55 has a first configuration as shown in FIG. 4 and a second configuration as shown in FIG. 11. In the second configuration, the convertible portion 55 forms the desk organizer 26. The convertible portion 55 has a first bottom panel 190, a top panel 192, and a back panel 194. The back panel 194 is demarcated from the bottom and top panels 190, 192 by two sets of adjacent fold lines 196. A bottom panel edge 198 and a top panel edge 200 are configured to mechanically fit together. As shown in FIG. 11, the convertible portion 55 is folded along fold lines 196 to bring the edges 198, 200 into contact, placing the top panel 192 in a raised configuration with respect to the bottom panel 190.

Tab 202 on the bottom panel edge 198 and notch 204 on the top panel edge 200 fit together, facilitating alignment between the top and bottom panels 190, 192. The convertible portion 55 also has a number of notches 206. In the second configuration, the notches 206 are aligned, facilitating placement of an elastic band 79 around the desk organizer 26, which helps maintain the desk organizer 26 in the second configuration. The top panel 192 has one or more holes 210 that are sized for holding a writing utensil such as a pen or a pencil, for example. The holes 210 are vertically aligned with holes 212 in the bottom panel 190. A writing utensil is optionally disposed through the one or more holes 210, and the tip of the writing utensil is disposed in a corresponding hole 212, helping to allow the writing utensil to be held in an upright fashion. As shown in FIG. 4, the holes 212 in the bottom panel 190 are smaller than the holes 210 in the top panel 192. The smaller holes 212 are configured to securely hold the smaller diameter of the tip of the writing utensil, while the larger holes 210 are configured to accommodate the larger diameter of the shaft of the writing utensil. Further, the desk organizer 26 also has a slot 208 formed in the top panel 192. The slot 208 is shaped and configured for holding papers (e.g., business cards) or other items in an upright manner.

Figure 12:
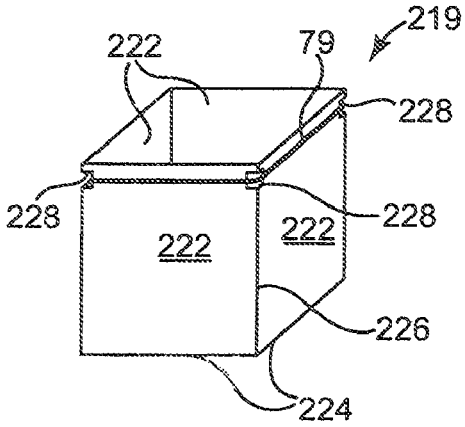
FIG. 12 shows a convertible portion of a packaging assembly converted into the form of a cup holder, according to some embodiments.

Convertible portion 56 has a first configuration shown in FIG. 4 and a second configuration shown in FIG. 12. In the second configuration, the convertible portion 56 forms a cup holder 219. The convertible portion 56 has a base panel 220 and four side panels 222. The side panels 222 are demarcated from the base panel 220 by fold lines 224. Each side panel 222 has two vertical sides 226. When the side panels 222 are folded upward with respect to the base panel 220, as shown in FIG. 12, the vertical sides 226 are adjacent, or in contact with, one another. Further, the side panels have notches 228. The notches 228 are aligned with one another when the convertible portion 56 is in the second configuration. An elastic band 79 is optionally disposed around the cup holder 219 in order to help maintain the cup holder 219 in the second configuration. Also, the convertible portion 56 optionally has alignment notches and tabs (not shown) to help facilitate the alignment of the side panels 222, as shown on convertible portion 48 in FIG. 3.

Figure 13:
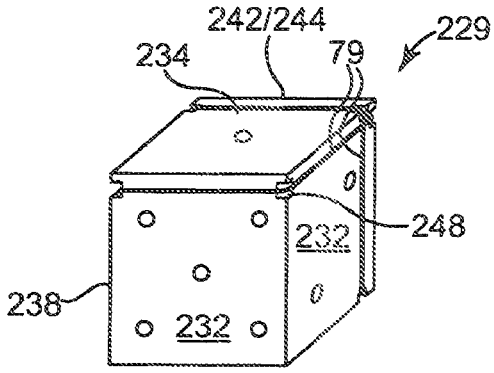
FIG. 13 shows a convertible portion of a packaging assembly converted into the form of a decorative pencil holder, according to some embodiments.

Convertible portion 57 has a first configuration as shown in FIG. 4 and a second configuration as shown in FIG. 13. In the second configuration, the convertible portion 57 forms a decorative pencil holder 229. The convertible portion 57 has a first base panel 230, four side panels 232 and a top panel 234. The base panel 230 is demarcated from the side panels 232 along fold lines 236. The side panels 232 each have two vertical edges 238 that are adjacent to, or in contact with, one another when side panels 232 are folded with respect to the base panel 230, as shown in FIG. 13. The top panel 234 is demarcated from one of the side panels 232 along fold line 240. The top panel 234 is folded in a direction that forms the closed box configuration shown in FIG. 13, bringing edges 242 and 244 adjacent to, or in contact with, one another.

Further, each side of the decorative pencil holder 229 has holes 246 formed therein. Elongate instruments, such as writing utensils, are optionally placed in these holes 246 for storage. The convertible portion 57 also has notches 248. As shown in FIG. 13, these notches 248 are aligned within one another in two groups and an elastic band 79 is placed around the decorative pencil holder 229 through each group of notches 248 in order to help maintain the decorative pencil holder 229 in the second configuration.

Figure 14:
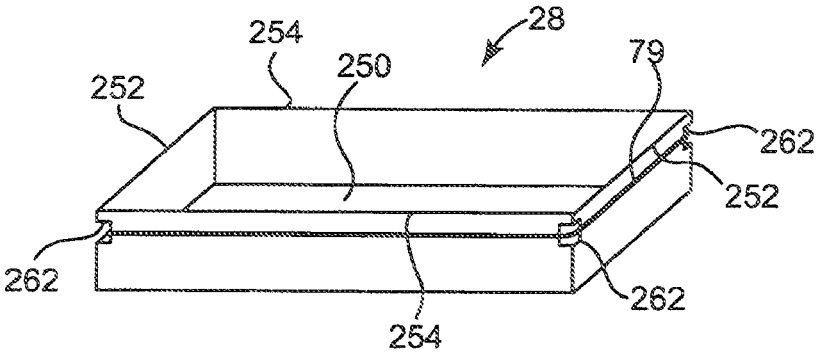
FIG. 14 shows a convertible portion of a packaging assembly converted into the form of an inbox, according to some embodiments.

Convertible portion 58 has a first configuration as shown in FIG. 4 and a second configuration as shown in FIG. 14. In the second configuration, the convertible portion 58 forms an inbox or outbox (which will be referred to simply as an "inbox 28" for convenience). The convertible portion 58 has a base panel 250, end panels 252, and side panels 254. In some embodiments, the base panel 250 is sized slightly larger than a standard 8.5 inch by 11 inch paper to accommodate papers being placed in the inbox. The end and side panels 252, 254 are demarcated from the base panel 250 by fold lines 256, 258, respectively. The side and end panels 252, 254 have vertical side edges 260. In the second configuration, the side and end panels 252, 254 are all folded in the same direction at about 90 degrees, and the vertical side edges 260 form the corners of the box, as shown in FIG. 14. The side and end panels 252, 254 also have notches 262 on the vertical side edges 260. These notches 262 are lined up with one another when the convertible portion 58 is in the second configuration, and an elastic band 79 is placed around the inbox 28, helping to maintain the inbox 28 in the second configuration.

Figure 15:
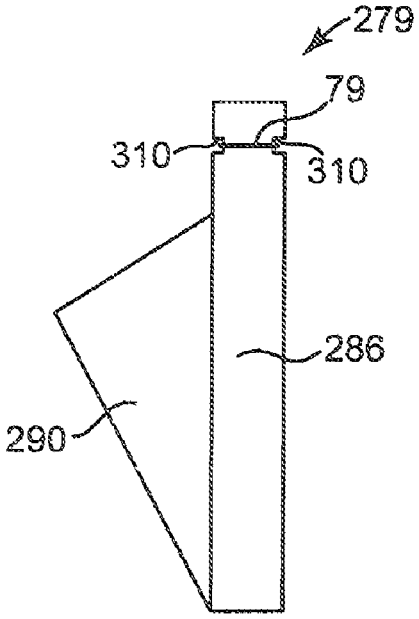
FIG. 15 shows a convertible portion of a packaging assembly converted into the form of a side view of an electronic device holder, according to some embodiments.
Figure 16:
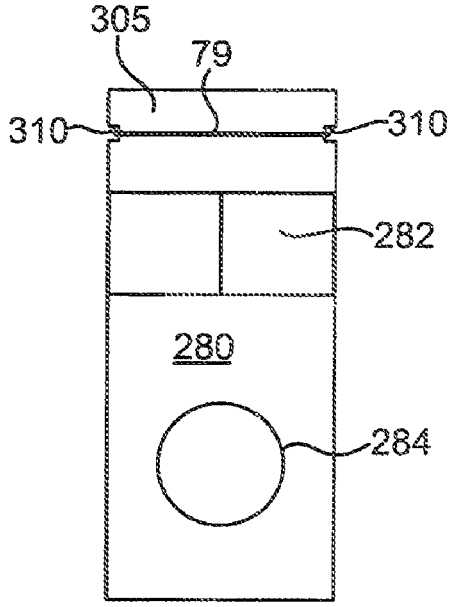
FIG. 16 shows a convertible portion of a packaging assembly converted into the form of an electronic device holder, according to some embodiments.

Convertible portion 59 has a first configuration as shown in FIG. 4 and a second configuration as shown in FIGS. 15 and 16. In the second configuration, the convertible portion 59 forms a holder 279 for an electronic device, for example those sold under the tradename "IPOD" by APPLE, INC. The electronic device holder 279 has a front panel 280 with first and second cut-outs 282, 284. The first cut-out 282 is configured to view a screen of an electronic device, and the second cut-out 284 is configured to view and/or access a controller for the electronic device. As shown in FIG. 4, the first cut-out 282 is positioned above the second cut-out 284. Further, the first cut-out 282 is rectangular and the second cut-out 284 is round, although these cut-outs are optionally any other suitable shape as desired.

The convertible portion 59 also has side panels 286, back panels 288 and flaps 290. The side panels 286 are demarcated from the front panel 280 by fold lines 292. The side panels 286 are folded back, forming the sides of the electronic device holder 279. The back panels 288 are demarcated from the side panels 286 by fold lines 294. The back panels 288 are further folded back behind the front panel 280, as shown in FIGS. 15 and 16. The flaps 290 are demarcated from the back panels 288 by fold lines 296. The flaps 290 are folded in a direction away from the back of the electronic device holder 279, as shown in the side profile of FIG. 15. The electronic device holder 279 is optionally rested on the flaps 290, which holds the electronic device holder 279 in an upright position for easier viewing of the electronic device.

Further, the convertible portion 59 has a bottom panel 297 and a back overlay panel 298. A slot 300 is formed in the back overlay panel 298 that is adapted to accommodate the flaps 290. The bottom panel 297 is demarcated from the front panel 280 by fold line 302 and the bottom panel 297 is demarcated from the back overlay panel 298 by fold line 303. The bottom panel 297 is folded backward along the fold line 302 to form the bottom of the electronic device holder 279. The overlay panel 298 is further folded to the back of the electronic device holder 279 so that it overlays the back panels 288 and so that the flaps 290 extend through the slot 300.

The convertible portion 59 also has a top panel 304 and a front panel overlay 305. The top panel 304 is demarcated from the back panel overlay 298 by fold line 306. The top panel 304 is folded forward along the fold line 306 over the top of the electronic device holder 279, forming the top of the electronic device holder 279. The front panel overlay 305 is demarcated from the top panel 304 by fold line 307. The front panel overlay 305 is folded down over a portion 308 of the front panel 280, as shown in FIG. 16. Notches 310 are also formed around the top portion of the electronic device holder 279. An elastic band 79 is optionally disposed around the electronic device holder 279 to help maintain the electronic device holder 279 in the second configuration.

While FIGS. 1 and 2 show a desk as the primary product 10, in some embodiments other primary products 10 are shipped in packaging assemblies with convertible portions. For example, in some embodiments the primary product is a shelf or book case (not shown) that is packaged in a packaging assembly. The packaging assembly has a convertible portion with first and second configurations, similar to any of the packaging assemblies described herein. In the first configuration, the convertible portion is configured as a part of the packaging assembly. In the second configuration, the convertible portion is configured as an accessory product for the shelf or book case. In some embodiments, the packaging assembly has one or more convertible portions that form a picture frame in a second configuration (e.g., as shown in FIG. 9), one or more convertible portions that form a CD or DVD storage case in a second configuration (e.g., as shown in FIG. 8), one or more convertible portions that form a coaster in a second configuration (e.g., as shown in FIG. 7), one or more convertible portions that form a pencil holder in a second configuration (e.g., as shown in FIG. 6), or one or more convertible portions that form a rack in a second configuration (e.g., as shown in FIG. 10), or any other suitable convertible portions, or any combination thereof.

In other embodiments, the primary product is a chair (not shown) that is packaged in a packaging assembly. The packaging assembly has convertible portions with first and second configurations, similar to any of the packaging assemblies described herein. In the first configuration, the convertible portion is configured as a part of the packaging assembly. In the second configuration, the convertible portion is configured as an accessory product for the chair. In some embodiments, the packaging assembly has one or more convertible portions that form a coaster in a second configuration (e.g., as shown in FIG. 7), one or more convertible portions that form a pencil holder in a second configuration (e.g., as shown in FIG. 6), or one or more convertible portions that form an electronic device holder in a second configuration (e.g., as shown in FIGS. 15 and 16), or any other suitable convertible portions, or any combination thereof.

In yet other embodiments, the primary product is an ottoman, a footrest, an end table, or any other article of furniture. The article of furniture is packaged in a packaging assembly. The packaging assembly has convertible portions that have first configurations and second configurations as described herein. In the first configuration, the convertible portion is configured as a part of the packaging assembly. In the second configuration, the convertible portion is configured as an accessory product for the article of furniture.

Figure 17:
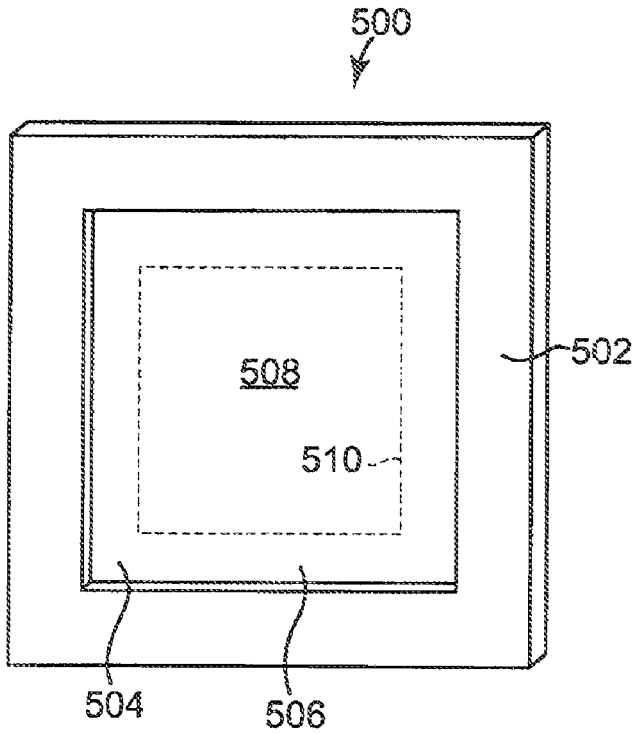
FIG. 17 shows a picture frame with a convertible matte disposed in the frame, according to some embodiments.

In addition, as shown in FIG. 17, in some embodiments, a picture frame 500 has a frame 502 that forms a display opening. During shipment and/or display at a retailer, the frame 502 has a packaging material 504 disposed in the frame. The packaging material 504 has an edge portion 506 and a central portion 508. The central portion 508 is demarcated from the edge portion 506 by perforation line 510. The perforation line 510 helps to facilitate the removal of the central portion 508 from the packaging material 504. The remaining edge portion 506 is suitable for a matting for the picture frame. As such, the packaging material 504 has a first configuration for storage and/or shipment and a second configuration (with the central portion 508 removed) for use with the primary product (the frame).

A method of shipping a primary product includes the step of providing a packaging assembly, for example any of the packaging assemblies described herein. In some embodiments, the packaging assembly includes a container and also optionally includes a protective insert. The packaging assembly has a convertible portion (e.g., any of the convertible portions described herein), and the convertible portion has a first and a second configuration. In the first configuration, the convertible portion is configured as a part of the packaging assembly. In the second configuration, the convertible portion is configured as an accessory product for the primary product. The primary product is disposed in the container. The optional protective insert is disposed in the container between the primary product and a wall of the container and/or around or between portions of the primary product. The container is then closed and secured for shipment.

A method of assembling a primary product includes providing a packaged primary product. The packaged primary product is disposed in a packaging assembly, for example any of the packaging assemblies described herein. In some embodiments, the packaging assembly includes a container and also optionally includes a protective insert. The packaging assembly has a convertible portion (e.g., any of the convertible portions described herein), and the convertible portion has a first and a second configuration. In the first configuration, the convertible portion is configured as a part of the packaging assembly. In the second configuration, the convertible portion is configured as an accessory product for the primary product.

The packaging assembly is opened and the primary product is removed from the package. The optional protective inserts are also removed from the packaging assembly. In some embodiments, the convertible portions are separated from the non-convertible portions of the packaging assembly, for example by separating the convertible portion from the non-convertible portions along one or more perforated lines. The convertible portion is altered from a first configuration to a second configuration by folding or otherwise manipulating the convertible portion. In some embodiments, as described above, the convertible portion has fold lines, and the convertible portion is folded along these fold lines. In the second configuration, the convertible portions are configured as accessory products for the primary product. In addition, in some embodiments the convertible portions have notches. These notches are aligned, for example as described and shown above with respect to each convertible portion in FIGS. 3-16, and an elastic band is placed around a portion of the accessory product in order to help securely maintain the convertible portion in the second configuration.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The following is claimed:

1. A method of packing a furniture member with one or more furniture accessories, the method comprising:

providing a shipping assembly having an outer container that is adapted to house the furniture member and a protective member, the protective member is a separate piece from the outer container;

manipulating a portion of the protective member to create one or more modifiable sections, the one or more modifiable sections being adapted to transition from a shipping configuration to an accessory configuration, wherein in the accessory configuration the one or more modifiable sections form the one or more furniture accessories; and packing the furniture member in the outer container with the modifiable sections in the shipping configuration.

2. The method of claim 1, wherein the protective member is an insert adapted to be housed in the outer container with the furniture member.

3. The method of claim 2, wherein perforating the portion of the protective member includes perforating the protective member to create a plurality of modifiable sections.

4. The method of claim 1, further comprising creating fold lines in the one or more modifiable sections in order to facilitate the transition of the one or more modifiable sections from the shipping configuration to the accessory configuration.

5. The method of claim 1, wherein the one or more modifiable sections are disposed in the shipping configuration as part of the shipping assembly to protect the furniture member.

6. A method of packaging a product for shipping comprising:

providing an outer container for receiving a primary product in a disassembled state, the primary product in an assembled state having a plurality of interconnected parts;

providing a packaging member operably associated with the outer container, the packing member including at least one convertible portion, the at least one convertible portion being separable from a remaining portion of the packaging member and being modifiable into a secondary product that is complementary to the primary product when the primary product is in the assembled state wherein no portion of the secondary product and no portion of the primary product is formed from the outer container; and inserting the primary product in the disassembled state into the outer container.

7. The method of claim 6, wherein the packaging member is made of sheet material and is at least partially in a flat configuration.

8. The method of claim 6, wherein the at least one convertible portion includes at least one demarcated fold line for modifying the at least one convertible portion into the secondary product.

9. The method of claim 6, wherein the packing member includes a plurality of convertible portions, each of the plurality of convertible portions being separable from a remaining portion of the packaging member and being modifiable into a secondary product that is complementary to the primary product when the primary product is in the assembled state.

10. The method of claim 6, wherein the secondary product is configured to be supported by at least one surface of the primary product.

11. The method of claim 6, wherein the secondary product is substantially smaller than the primary product.

12. A method of packing a furniture member with one or more furniture accessories, the method comprising:

providing a plurality of parts that when assembled form a furniture member;

providing a packaging assembly including an outer container for housing the plurality of parts and a protective insert to help protect at least one of the plurality of parts from damage, the protective insert having at least one convertible portion adapted to be removed from a surrounding portion of the protective insert and transitioned between a first flat configuration to an independent erected second configuration, whereby the convertible portion forms an accessory product for the furniture member when the convertible portion is in the second configuration; and, inserting the protective insert in the outer container.

13. The method as recited in claim 12, wherein:

the protective insert includes a plurality of convertible portions adapted to be removed from a remaining portion of the protective insert and transitioned between a first flat configuration to an independent erected second configuration, whereby each of the plurality of convertible portions forms an accessory product for the furniture member when each of the plurality of convertible portions is in the second configuration.

14. The method as recited in claim 13, wherein:

the plurality of parts includes a desk top; and, the accessory product formed from each of the plurality of convertible portions is adapted be supported on the desk top when the plurality of parts are assembled to form the furniture member and the accessory product is in the second configuration.

15. The method as recited in claim 13, wherein:

one of the plurality of parts forms a substantially horizontally extending support surface of the furniture member and the accessory product formed from each of the plurality of convertible portions is adapted to be supported on top of the substantially horizontally extending support surface of the furniture member when the plurality of parts are assembled to form the furniture member and the accessory product is in the second configuration.

16. The method as recited in claim 12, further comprising the steps of:

inserting the plurality of parts in the outer container; and, positioning the protective insert between at least one of the plurality of parts and another of the plurality of parts.

17. The method as recited in claim 12, wherein:

the convertible portion is defined by weakened areas in the protective insert.

18. The method as recited in claim 12, wherein:

the plurality of parts includes a desk top and the accessory product when in the second configuration is adapted to be supported on the desk top when the plurality of parts are assembled.

19. The method as recited in claim 12, further including the step of:

positioning the protective insert in the outer container such that the protective insert extends substantially parallel to a top and a bottom of the outer container.

20. The method of claim 12, wherein:

the outer container and the protective insert are formed of cardboard;

the furniture member includes at least one of a desk, a shelf, an ottoman, a chair, and a table; and, wherein the accessory product includes at least one of a portfolio, a pencil holder, a coaster, a CD case, a picture frame, a CD holder, a file divider, a file folder, a desk organizer, a cup holder, a decorative utensil holder, an inbox, and an electronic device holder.

* * * * *